US005153943A

United States Patent [19]

Clement

[11] Patent Number: 5,153,943

[45] Date of Patent: Oct. 13, 1992

[54] WEATHER-SHIELD HAT ACCESSORY

[76] Inventor: Keith H. Clement, 5445 New River Rd., Cave Creek, Ariz. 85331

[21] Appl. No.: 754,836

[22] Filed: Sep. 4, 1991

[51] Int. Cl.[5] ..... A42B 1/06

[52] U.S. Cl. ..... 2/199; 2/172; 2/209.1

[58] Field of Search ..... 2/171, 172, 185 R, 195, 2/196, 199, 207, 209.1

[56] References Cited

U.S. PATENT DOCUMENTS

| | | | |
|---|---|---|---|
| 535,143 | 3/1895 | Mendelson | 2/172 |
| 822,986 | 6/1906 | Rochet | 2/172 |
| 1,008,109 | 11/1911 | Bickerton . | |
| 1,690,736 | 11/1928 | Leicht | 2/172 |
| 2,446,288 | 8/1948 | Lindley . | |
| 2,462,679 | 2/1949 | Rosenau . | |
| 2,897,510 | 8/1959 | Forbes-Robinson | 2/195 |
| 4,556,991 | 12/1985 | Margaronis et al. . | |
| 4,872,218 | 10/1989 | Holt . | |
| 4,980,928 | 1/1991 | Ellis . | |
| 5,035,004 | 7/1991 | Koester | 2/199 |
| 5,046,195 | 9/1991 | Koritan | 2/199 |
| 5,081,717 | 1/1992 | Shedd | 2/209.1 |

*Primary Examiner*—Werner H. Schroeder
*Assistant Examiner*—Diana L. Biefeld
*Attorney, Agent, or Firm*—Schmeiser, Morelle & Watts

[57] ABSTRACT

The invention is a flexible weather-shield that can be attached to any hat having a forward visor and a rear size adjustment system. The shield includes an elastic band that can be placed atop the hat's visor. The rear of the shield includes a fastening system that releasably attaches the shield to the hat's size adjustment apparatus. The shield further includes its own size adjustment apparatus that adapts the shield to the dimensions of the hat or the wearer. Fasteners are located along portions of the front edges of the shield to enable the shield to be closed over a forward portion of a wearer's neck.

21 Claims, 2 Drawing Sheets

FIG. 2
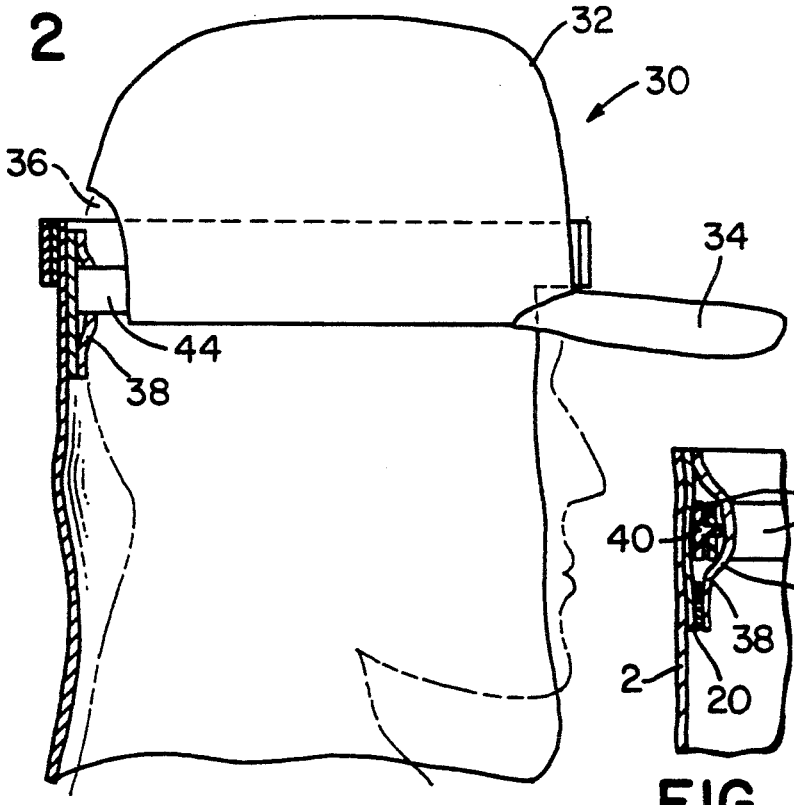
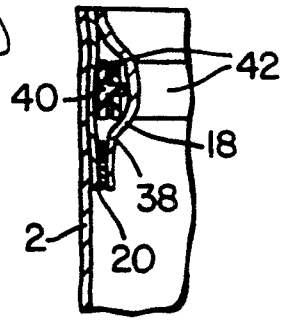
FIG. 4
FIG. 3
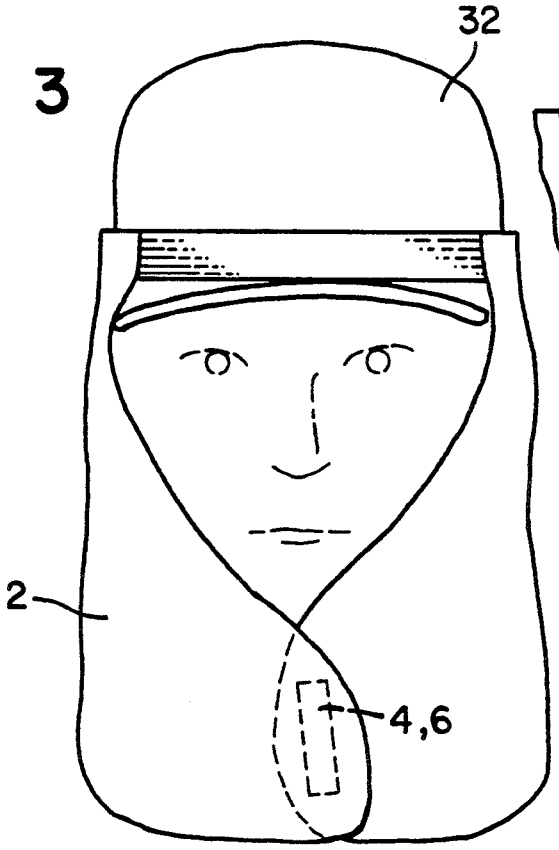
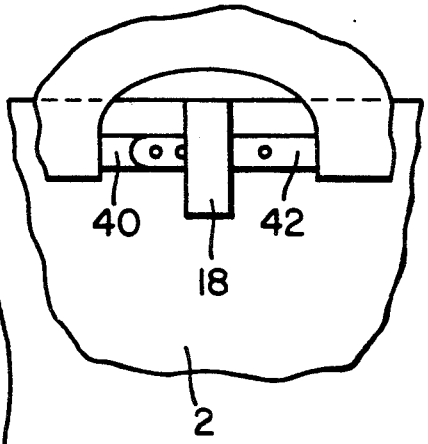
FIG. 5

WEATHER-SHIELD HAT ACCESSORY

FIELD OF THE INVENTION

The invention is in the field of hat accessories. More particularly, the invention is a flexible weather-shield that can be suspended from a hat. Once in place, the shield drapes over and protects the wearer's ears and neck from adverse weather conditions.

BACKGROUND OF THE INVENTION

In many fields of endeavor, a worker is required to be exposed to adverse climatic conditions for extended periods of time. For example, a construction worker may be continuously exposed to strong sunlight for eight hours a day. The same worker may also be exposed to high winds or to extreme cold for similar extended periods of time.

This prolonged exposure can lead to a number of physical problems. The sun exposure can at a minimum cause a sunburn of the skin. Over a long period of time, repeated over-exposure to the sun can result in skin cancer.

Exposure to high winds can result in windburn, drying of the skin and abrasion of the skin. Prolonged exposure of the skin to wind can result in premature aging of the skin.

During cold weather, an outdoor worker will normally suffer some exposure of his or her skin to the cold. The result of this exposure can range from mild discomfort to frostbite.

As is well known, there are many types of apparel that are commonly used to protect one's neck and ears from the elements. Hats and scarfs are two well-known examples of apparel used for this purpose.

Hats are often used to protect the wearer from the sun. A problem with hats is that when the sun is not directly overhead, the rays of sunlight are able to impinge on the wearer's neck, face and ears. A similar exposure can occur even at midday if the worker has his or her head bent at an angle. For example, a construction worker using a shovel will normally be standing with his or her head bent forward looking toward the bottom tip of the shovel. In this position, even with a hat, the worker's neck and possibly ears will be exposed to the direct sunlight.

During cold or windy conditions, a person working outdoors may wear a hat in combination with a scarf or bandana to shield his or her ears and neck from the elements. When this type of apparel is in place, it can be an effective shield against these weather conditions. The problem with these forms of apparel is that they require the user to constantly adjust their position since the user's movements cause them to shift from their initially placed position.

To improve on the basic hat, many inventors have developed hat accessories that attach to a hat to increase its shielding abilities.

Bickerton (U.S. Pat. No. 1,008,109) teaches an adjustable sunshade member that is removably secured to the exterior of a hat. The Bickerton shade is hung from the hat's rigid crown using a wire loop. A wire loop cannot be comfortably used on modern hats that have a flexible crown. In addition, the Bickerton device requires adjustment whenever the wearer changes position relative to the sun.

Rosenau (U.S. Pat. No. 2,462,679) and Lindley (U.S. Pat. No. 2,446,288) both teach removable plastic shields that are designed to attach to the exterior of a hat. These devices are limited in their ability to adjust to different size hats and also include attachment mechanisms that only provide localized support of the shields.

Ellis (U.S. Pat. No. 4,980,928) teaches a cap that includes a deployable cape member. The cape is normally housed within the interior of the hat proximate the hat's brim. When required, the cape is unrolled downwardly and is capable of covering the wearer's neck and shoulders. One embodiment of the invention shows a cape that can cover the wearer's entire body. This device, while unique, is bulky and the cape's attachment apparatus does not provide any adjustability for hat or head size to achieve proper fit.

The first objective of the invention is to provide a device that can be removably attached to a hat and which functions to shield the wearer's neck and ears from adverse weather conditions.

The second objective of the invention is to provide a removable shield that can be uniformly supported by the hat without causing discomfort to the wearer.

The third objective of the invention is to provide a removable weather-shield that can be adjusted to fit different hat sizes or to conform to the dimensions of the particular wearer.

A fourth objective of the invention is to provide a weather-shield that can be easily disengaged from a hat and which does not interfere with the hat's adjustment apparatus.

SUMMARY OF THE INVENTION

The invention is a hat accessory in the form of a removable weather-shield. The shield itself is made from a flexible material that is removably attached to the bottom portion of a hat. When in place, the shield extends downwardly to cover the neck and ears of the wearer.

The shield includes a two part attachment apparatus that enables it to be uniformly supported by the hat. The first part of the attachment apparatus comprises a stretchable band that extends forwardly from the top of the flexible shield and fits over the hat's visor. When in place, the flexible band provides a forward support point for the shield. The second part of the attachment apparatus is located at the rear of the shield along its upper portion and functions to attach the rear of the shield to a hat's rear adjustment band.

The shield's attachment apparatus is also designed to enable the quick attachment or detachment of the shield from the hat. In addition, the form of the attachment apparatus allows the wearer to adjust the hat's adjustment band with little or no interference from the attached weather-shield. As will be described later, the user can adjust the size of the hat even when the weather-shield is in place on the hat.

The weather-shield further includes an adjustment apparatus that allows it to be adjusted to fit the particular wearer or hat. In the preferred embodiment, the adjustment apparatus comprises a movable strap that is adjustably fastened to the shield at two separated locations. By locating the strap in a manner whereby the two spaced fastening points are brought closer together, the wearer can alter the size of the shield to fit a smaller hat or head size.

The flexible shield portion of the invention can be manufactured from any number of materials with the material selection being dependent on the intended use of the shield. For example, to shield the wearer from the sun, the material of choice would be a lightweight, white cotton fabric. This type of material is capable of protecting the wearer from the sun's rays while still allowing some ventilation of the skin. In addition, a cotton material is capable of absorbing some of the wearer's sweat and thereby maintains the wearer's natural evaporative cooling process. Once the cotton fabric shield becomes soiled, it can be easily removed from the hat and washed.

To protect the wearer from the wind, the shield is preferably manufactured from a canvas or other tightly woven material. This type of material protects the wearer from flying particles and reduces the drying action of the wind on the wearer's skin.

For cold weather protection, the flexible shield can be manufactured from an insulating material such as wool or a multi-layered synthetic insulating material such as THINSULATE.

BRIEF DESCRIPTION OF THE DRAWINGS

FIG. 2 is a cross-sectional side view of the invention shown in FIG. 1 with the invention shown attached to a hat and being worn by a user.

FIG. 3 is a front view of the invention as shown in FIG. 2.

FIG. 4 is a detailed side view of the rear portion of the shield's attachment apparatus in place on a hat's rear adjustment band.

FIG. 5 is a detailed view of the structure shown in FIG. 4 as seen from a point within the hat.

DETAILED DESCRIPTION OF THE DRAWINGS

Figure 1:
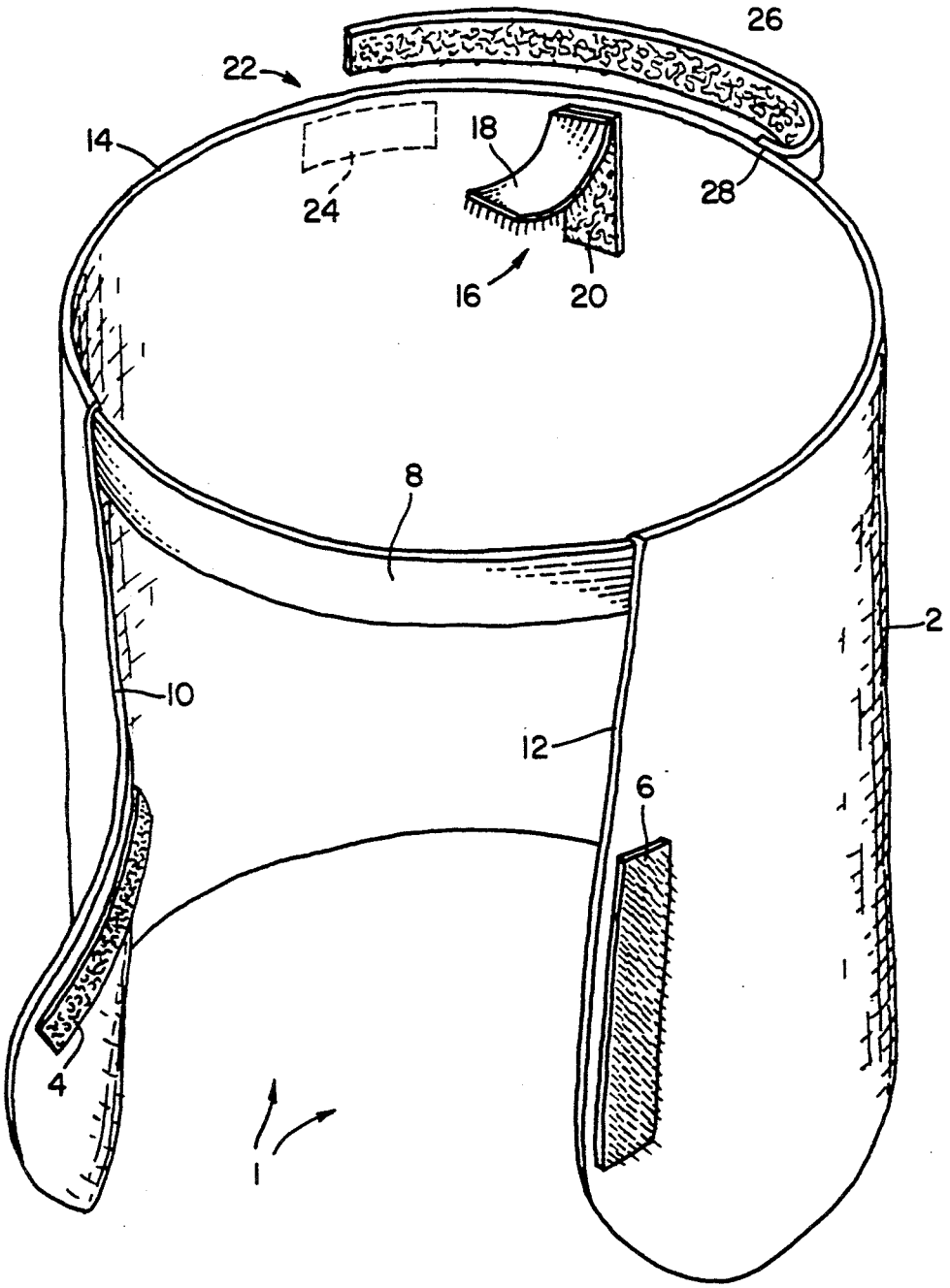
FIG. 1 is a perspective view of a weather-shield hat accessory in accordance with the invention.

Referring now to the drawings in greater detail, wherein like reference characters refer to like parts throughout the several figures, there is shown by the numeral 1 a weather-shield accessory for a hat in accordance with the invention.

The weather-shield includes a shield portion 2 formed from an elongated piece of flexible material that has the ability to shield the wearer from particular aspects of the weather. For example, when a sun shield is required, the portion 2 could be manufactured from a light-weight, white cotton material. As a cold weather shield, the portion 2 could be made from a wool or quilted material. The portion 2 is sized so that when it is attached to a hat, it extends downwardly and covers the wearer's ears and neck.

Located proximate the bottom of the front edges of shield portion 2 are a pair of complementary hook and loop fastening strips 4 and 6. Strip 4 is attached to an inner surface of the shield. Strip 6 is fastened in a complementary position on the shield's outer surface.

The weather-shield 1 includes a two-part system for attaching it to a hat. The first part comprises a flexible, elastic band 8 that is attached to the top of the shield portion's front edges 10 and 12. The band completes a circle partially formed by the top edge 14 of the shield portion 2.

Attachment apparatus 16 is located on the inside rear surface of the shield and forms the second part of the attachment system. The apparatus comprises two complementary portions of hook and loop fastening material 18 and 20.

Located proximate the top of the rear face of the shield is an adjustment apparatus 22 comprising another pair of complementary hook and loop fastening segments 24 and 26. Segment 24 is much shorter in length then segment 26 and is attached along its entire length to the shield. The loop portion of the fastening material is located on the outer surface of the segment. Segment 26 is preferably six to ten inches long and is attached to the shield at end 28 only. As shown, segment 26 includes the hook portion of the fastening material along the length of its inner face. A wearer can adjust the size of the shield by attaching segment 26 at various points along its length to segment 24. In this manner, the spacing between segment 24 and the fixed end 28 of segment 26 can be changed thereby reducing the diameter of the circular area bounded by the top perimeter of the weather-shield.

In FIGS. 2 and 3, the weather-shield is shown attached to a baseball-type hat 30 that is located on the head of a wearer. The hat consists of a top hemispherical portion 32 with a visor 34 located along the bottom edge of the front of the hat. The rear of the hat includes a semi-circular opening 36. At the base of the opening is located an adjustment apparatus 38.

The adjustment apparatus 38 shown is typical for this type of hat and includes two straps 40 and 42 that are aligned back to front. The straps are adapted so that they can be connected to each other at different points along their respective lengths. In this manner, the amount that they overlap each other can be varied to thereby change the diameter of the circular bottom edge 44 of the hat.

FIG. 3 provides a front view of the weather-shield-/hat combination shown in FIG. 2. In this figure, the front bottom portions of the shield are connected to each other via a connection between the hook and pile segments 4 and 6. As can be seen, the shield is capable of completely covering the wearer's neck and ears.

In FIGS. 4 and 5, a detailed view is provided of the rear attachment between the hat and weather-shield. In this view, a typical position locking mechanism is shown connecting the two bands 40 and 42 that are used to adjust the hat's size. Portions of each band overlap each other and band 40 includes extension members that project perpendicularly from the band's rear face. Band 42 includes a plurality of openings sized to inwardly receive the extension members. By selecting different sets of openings to receive the extension members, the relative positions of the two bands can be changed thereby changing the hat's size.

The shield's rear attachment strips 18 and 20 act to encircle the hat's adjustment bands and thereby releasably fasten the rear of the shield to the rear of the hat. This method of attachment allows the shield to be slidably fastened to the bands in a manner whereby some repositioning of the shield is allowed. This enables a wearer to adjust the hat without having to remove the shield. This fastening method also conversely allows the weather-shield to be moved on the attachment bands to compensate for changes made to the size of the shield or to the size of the hat. In addition, the ability to adjust the shield's position provides the wearer with the ability to slightly adjust the location of the shield to achieve proper fit.

In the figures, the shield is shown attached to a baseball-type hat. The shield can in exactly the same manner be attached to other types of hats that include similar adjustment structure. For example, the shield can be secured to a hard hat-type of hat that is normally worn to protect the wearer from impacts. For this type of hat, the shield's front band would be placed over the hat's rigidly fixed forward visor in a manner similar to that shown for a baseball-type hat. The rear attachment straps of the shield would then be secured to the hat's adjustment band normally found in the interior of the hat proximate its rear edge. The adjustment mechanism is basically similar to that used in baseball-type hats and the rear attachment of the shield would be made in the same manner as previously described. Once properly secured, the shield portion 2 would extend downwardly to cover the wearer's neck and ears.

The embodiment disclosed herein has been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention as described in the following claims.

I claim:

1. A weather-shield for a hat comprising:

a flexible shield member having a top portion, bottom portion, two side portions, a front face and a rear face;

a first attachment means connected to the top portion of the shield member wherein when said shield member is located on a hat, said attachment means functions to removably attach the shield member to a forward portion of the hat;

a second attachment means connected to the front face of the top portion of the shield member wherein when said shield member is located on a hat that includes a rear strap member, said second attachment means functions to removably attach the shield member to the hat's rear strap member;

an adjustment means at least partially located on the rear face of the shield member for adjusting the size of the top portion of the shield member, said adjustment means including a releasable fastening means that functions to releasably partially gather together the two side portions of the shield member; and wherein when the shield member is attached to a hat, the shield member extends downwardly from the hat and is capable of covering a wearer's neck and ears.

2. The weather-shield of claim 1 wherein said first attachment means comprises a flexible band that extends between the two side portions of the shield member and is capable of encircling a forward portion of a hat in a position wherein at least a forward portion of the band rests atop a visor portion of said hat.

3. The weather-shield of claim 2 wherein the flexible band of the first attachment means is made from a resilient, stretchable material.

4. The weather-shield of claim 1 wherein said second attachment means comprises a flexible fastening means that is capable of releasably capturing hat's rear strap member.

5. The weather-shield of claim 4 wherein the fastening means of the second attachment means comprises a flexible strap having a first end and a second end wherein said flexible strap is capable of at least partially capturing a hat's rear strap member between its first and second ends.

6. The weather-shield of claim 1 wherein the top portion of the shield member and the first attachment means form a circular loop and wherein the adjustment means is capable of changing the diameter of said circular loop.

7. The weather-shield of claim 6 wherein the adjustment means comprises a strap member that is fastened at a first end to the shield member proximate a first one of the shield member's side portions and wherein a second end of the strap member includes fastening means that allows it to be releasably fastened in a plurality of positions to a complementary fastening means located proximate a second of the shield members side portions.

8. The weather-shield of claim 1 wherein the shield member is made from a material made at least partially of cotton.

9. The weather-shield of claim 1 further comprising complementary fastening means located proximate a front edge of each of the shield member side portions for releasably fastening the two shield member side portions together.

10. A hat and removable weather-shield comprising:

a hat having a hemispherical main portion, a visor portion that extends outwardly from a front edge of the main portion and a size adjustment means located proximate a rear portion of the main portion for adjusting the size of the hat; and a flexible weather-shield comprising a fabric shield member, a forward attachment means for attaching the shield member to a forward portion of the hat above the visor, a rear attachment means that releasably attaches the shield member to the hat's size adjustment means and an adjustment means located on a surface of the shield member for adjusting the size of a top portion of the shield member, said adjustment means including a releasable fastening means that functions to releasably partially gather together two side portions of the shield member.

11. The hat and weather-shield of claim 10 wherein the forward attachment means of the weather-shield comprises a flexible strap that extends between two separated side edges of the shield member.

12. The hat and weather-shield of claim 10 wherein the rear attachment means of the weather-shield comprises a flexible band member that at least partially captures the hat's size adjustment means.

13. The hat and weather-shield of claim 10 wherein the adjustment means functions to adapt the weather-shield to fit onto different sizes of hats.

14. The hat and weather-shield of claim 10 wherein the shield member extends at least half-way around the hat and extends downwardly for a predetermined distance to thereby be capable of covering a wearer's ears and neck.

15. A weather-shield attachment for a hat consisting essentially of:

a shield member in the form of a sheet of flexible material, a forward attachment means for attaching the shield member to a forward portion of a hat, a rear attachment means that functions to releasably attach the shield member to a hat's size adjustment means and an adjustment means located on a surface of the shield member for adjusting the size of a top portion of the shield member, said adjustment means including a releasable fastening means that functions to releasably partially gather together two side portions of the shield member wherein when the weather-shield is attached to a hat and the hat is worn by a wearer, the shield member extends downwardly from the hat and is capable of covering the wearer's neck and ears.

16. The weather-shield of claim 15 wherein the forward attachment means of the weather-shield comprises a flexible strap that extends between two separated side edges of the shield member.

17. The weather-shield of claim 15 wherein the rear attachment means of the weather-shield comprises a flexible band member that is capable of at least partially capturing a hat's size adjustment means when said size adjustment means comprises an elongated band.

18. The weather-shield of claim 15 wherein the adjustment means functions to adapt the weather-shield to fit onto different sizes of hats.

19. The weather-shield of claim 15 wherein the shield member is capable of extending at least half-way around a hat's bottom perimeter.

20. The weather-shield of claim 15 wherein the shield member has two side portions and wherein the weather-shield further comprises complementary fastening means located proximate a front edge of each of the shield member side portions for releasably fastening the two shield member side portions together.

21. A weather-shield for a hat comprising:

a flexible shield member having a top portion, bottom portion and two side portions;

a first attachment means connected to the top portion of the shield member wherein when said shield member is located on a hat, said attachment means functions to removably attach the shield member to a forward portion of the hat;

a second attachment means connected to the top portion of the shield member wherein when said shield member is located on a hat that includes a rear strap member, said second attachment means functions to removably attach the shield member to the hat's rear strap member;

wherein when the shield member is attached to a hat, the shield member extends downwardly from the hat and is capable of covering a wearer's neck and ears;

wherein the top portion of the shield member and the first attachment means form a circular loop and wherein the weather-shield further comprises an adjustment means located on the shield member that is capable of changing the diameter of said circular loop; and wherein the adjustment means comprises a strap member that is fastened at a first end to the shield member proximate a first one of the shield member's side portions and wherein a second end of the strap member includes fastening means that allows it to be releasably fastened in a plurality of positions to a complementary fastening means located proximate a second of the shield members side portions.

* * * * *